US007591683B2

(12) United States Patent
Zhang et al.

(10) Patent No.: US 7,591,683 B2
(45) Date of Patent: Sep. 22, 2009

(54) CONTACT TERMINAL, EXTENDER WITH IMPROVED GROUND CONTACT, AND METHOD FOR MAKING THE EXTENDER

(75) Inventors: George (Huanyi) Zhang, Irvine, CA (US); Wei Yuan, Shenzhen (CN); Tsu-Yang Wu, Tu-cheng (TW); Hai-Jun Wang, Shenzhen (CN); Gustavo F. Duenas, Placentia, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,683

(22) Filed: Jun. 19, 2008

(65) Prior Publication Data

US 2008/0305690 A1 Dec. 11, 2008

Related U.S. Application Data

(63) Continuation-in-part of application No. 11/810,814, filed on Jun. 7, 2007, now Pat. No. 7,497,739.

(51) Int. Cl.
*H01R 25/00* (2006.01)

(52) U.S. Cl. ..... 439/638; 439/79

(58) Field of Classification Search ..... 439/79, 439/638, 80, 76.1, 608
See application file for complete search history.

(56) References Cited

U.S. PATENT DOCUMENTS

| | | | | |
|---|---|---|---|---|
| 4,533,202 | A * | 8/1985 | Pohl | 439/638 |
| 6,071,150 | A | 6/2000 | Tang et al. | |
| 6,364,713 | B1 | 4/2002 | Kuo | |
| 6,663,434 | B1 | 12/2003 | Wu | |
| 6,918,774 | B2 | 7/2005 | Wu | |

* cited by examiner

*Primary Examiner*—Javaid Nasri
(74) *Attorney, Agent, or Firm*—Wei Te Chung

(57) ABSTRACT

An extender (1) comprises a female connector (2) and a male connector (3) assembled together to be electrical connection to a printed circuit board (9). A plurality of differential pairs of signal contact (51) and a plurality pairs of ground contact (53) with the pairs of signal contacts (51) arranged therebetween are secured in the extender (1). Each of the differential pairs of signal contact (51) and ground contact (53) has a first contact engaging portion (511), (531) which accessible from the female connector (2), and includes a second contact engaging portion (513), (533) extending away from the first engaging portion (511), (531) and accessible from the male connector (3). The ground contact further comprises a tail portion (535) that is orthogonal to the first and second contact engaging portion (531), (533) for electrical connection to the printed circuit board.

19 Claims, 8 Drawing Sheets

CONTACT TERMINAL, EXTENDER WITH IMPROVED GROUND CONTACT, AND METHOD FOR MAKING THE EXTENDER

CROSS-REFERENCE TO RELATED APPLICATIONS

This application is a continuation-in-part of U.S. patent application Ser. No. 11/810,814 (hereinafter referred to as the '814 application), filed on Jun. 7, 2007, now U.S. Pat. No. 7,497,739 the contents of each of which are hereby incorporated by reference.

BACKGROUND OF THE INVENTION

1. Field of the Invention

The present invention relates to an extender, and more particularly to an extender for coupling an electrical device to a backplane and featured with a ground contact simultaneously interconnecting the electrical device, the backplane, and a circuit substrate on which the extender is mounted.

2. Description of the Related Art

U.S. Pat. No. 6,071,150 issued to Tang et al. on Jun. 6, 2000, discloses an extender (10) including a male section (12) and a female section (14) assembled together to be coupled between a female connector on a backplane in the computer and a male connector on a hard disk drive for establishing signal transmission between the hard disk drive and the backplane through the interconnections of such male and female sections. Specifically, the female section defines a female interface adapted for mating with the male connector from the hard disk drive, the male section defines an opposite male interface adapted to mate with the female connector from the backplane of the computer, and a plurality of contacts are configured to extend from the female interface towards the male interface for electrically connecting the female section with the male section. This configuration typically enables the female or male interface to supply one voltage for the male connector of the hard disk drive, or the female connector of the backplane.

U.S. Pat. No. 6,918,774 issued to Wu on Jul. 19, 2005 discloses an electrical connector (1) includes a dielectric housing (2) including front and rear housing portions (20, 22) each defining a number of juxtaposed channels (202) therein and an intermediate housing portion (24) interconnecting the front housing portion with the rear housing portion. A number of elongate circuit boards (3) are side by side retained in the housing along a second direction perpendicular to the first direction. The circuit boards include front and rear mating edges (30, 32) respectively received in the channels of the front and the rear housing portions for mating with complementary components.

U.S. Pat. No. 6,663,434 issued to Wu on Dec. 16, 2003 discloses an extender (10) includes a female portion (12) and a male portion (14) adapted to be back-to-back assembled. The female portion comprises a first housing (16) defining two slots (28) and a plurality of first contacts (18, 19). A plurality of first passageways (30) is defined in the first housing and communicates with the slots. The first contacts are retained into the first passageways. The male portion comprises a second housing (40) having a pair of tongues (46) and a plurality of second contacts (41). The tongues define a plurality of positioning slits (52, 53) for receiving the second contacts. Each of the first contacts is aligned and cooperated with a corresponding second contact to form a transmission path. Two pairs of latch devices (35, 60) are provided on opposite ends of the female portion and male potion for fastening each other.

In the past, the electrical device, such as a hard disk data storage, and a backplane on which the device is electrically interconnected, generally carry the same voltage, i.e. both are operated under the substantially identical working environment. However, when data transmission rate becomes faster and faster, their working environments have to change also so as to meet the requirements.

Among the contact terminals provided within the extender, some of them are assigned for transmitting data, and some of them are designated for providing power or working voltage from the backplane to the hard disk drive. In the past, both the hard disk drive and the back plane are operated under the same working voltage, typically 5 VDC. However, when the spindling speed of the hard disk drive become faster and faster, their working voltage is also increased from 5 VDC to 12 VDC.

The present problem the users confront, is that the female or male interface substantially requires an electronic device of a first predetermined voltage to be equipped therewith, while the electronic component available for the users has a second predetermined voltage. In other words, the conventional configuration has no capability to provide a flexible connection to different types of electronic devices, which may require voltages of different amounts.

In the previously filed '814 application, applicant initiated a novel design such that a first mating interface of an extender can be supplied a first working voltage, and a second mating interface of the extender can be supplied with a second working voltage transformed by a circuitry provided by the extender, and which is different to the first working voltage, and which indeed meets the current requirements and resolve the issues.

Currently, the hard disk drives available in the market can be operated under two different working voltages, i.e. 5 VDC and 12 VDC. On the other hand, the working voltage provided from the backplane can be either 5 VDC and 12 VDC. Unless there is an transforming arrangement on the extender, it is very much likely that the hard disk drive may not properly and functionally work along with the backplane, if the working voltages therebetween are different.

In addition, when the requirement regarding to the data transmission rate becomes higher and higher, differential pair of signal contacts are used, and once the differential pair of contacts are used, grounding or shielding of the differential pair of contacts becomes a new challenge to resolve. None of the above described prior arts consider the use of differential pair of contacts. In addition, a grounding arrangement between the first and second mating interfaces, and a circuit substrate on which the extender is mounted is not provided as well.

SUMMARY OF THE INVENTION

A major object of an embodiment of the present invention is to provide an electrical connector assembly for a flexible connection to electronic devices of requiring different predetermined voltages.

Still, it is an object of the present invention to provide a ground contact in which a first mating interface, a second mating interface, and a circuit substrate on which the connector is mounted are electrically and simultaneously interconnected providing robust and reliable shielding for the data transmitted with high speed.

An electrical connector assembly made according to an embodiment of the present invention comprises a female connector and a male connector assembled together to be electrically connected to a printed circuit board. The female connector includes a first mating face that interfaces with a mating face of a corresponding connector mounted on a hard disk drive. The male connector includes a second mating face opposite to the first mating face and adapted to mate with a connector mounted on a backplane. The connector assembly includes a mounting face that is orthogonal to the first and second mating faces and adapted to mate with the printed circuit board. The printed circuit board supplies two predetermined voltages for the female connector and/or the male connector, thereby achieving a flexible connection for the connector assembly to different types of hard disk and backplane.

According to one aspect of the present invention, the female connector includes a first insulative housing that has a first mating face and a first abutment face opposite to the female mating face. The female connector further comprises two contact modules that respectively having a first row of contacts insert molding to a first base and a second row of contacts insert molding to a second base. Each of the first row of contacts includes a first contact engaging portion which accessible from the first mating face of the female connector. Each of the second row of contacts includes a plurality of differential pairs of signal contact and a plurality pairs of ground contact with the pairs of signal contacts arranged therebetween. Each of the differential pairs of signal contact has a first contact engaging portion which accessible from the first mating face, and includes a second contact engaging portion extending away from the first engaging portion and accessible from the second mating face. The ground contact comprises a middle portion, a first contact engaging portion extends from the middle portion which be accessible from the first mating face, a second contact engaging portion extending from the middle portion and opposed to the first engaging portion and accessible from the second mating face, and a tail portion extending from the middle portion that is orthogonal to the first and second contact engaging portion for electrical connection to the printed circuit board. The ground contact further includes several separated wing portions extending from the middle portion and toward the adjacent differential pair signal contacts.

Yet, still according to another aspect of the present invention, the male connector includes a second insulative housing that has a second mating face and a second abutment face opposite to the second mating face. A plurality of passageways extend from the mating face to the abutment face for receiving the second engaging portion of the two rows of contacts from the female connector and a plurality of contacts that extend from the second mating face toward the mounting face. Each contact is a right angle configuration, with a second contact engaging portion which accessible from the second mating face, and a tailing portion extending orthogonal to the first contact engaging portion to be electrical connection to the printed circuit board.

Yet, still according to another aspect of the present invention, the first abutment face of the female connector and the second abutment face of the male connector include interengaging elements extending therefrom for fastening the female connector to the male connector. In addition, the connector assembly further includes a middle cover disposed on a top region between the female connector and the male connector, and a middle spacer on a bottom region between the female connector and the male connector. The middle spacer defines a plurality of through holes for receiving the tailing portions of the contacts to be penetrated therethrough so as to be electrical connection to the printed circuit board.

Due to the printed circuit board of providing two predetermined voltage for the first connector and/or the second connector, the mating face or the mating surface is capable of being coupled to the electronic devices of requiring different predetermined voltages. Thus, the electrical connector assembly provides a flexible connection to any commodity devices of different predetermined voltages.

Other features and advantages of the present invention will become more apparent to those skilled in the art upon examination of the following drawings and detailed description of preferred embodiments.

DETAILED DESCRIPTION OF PREFERRED EMBODIMENTS

Figure 1:
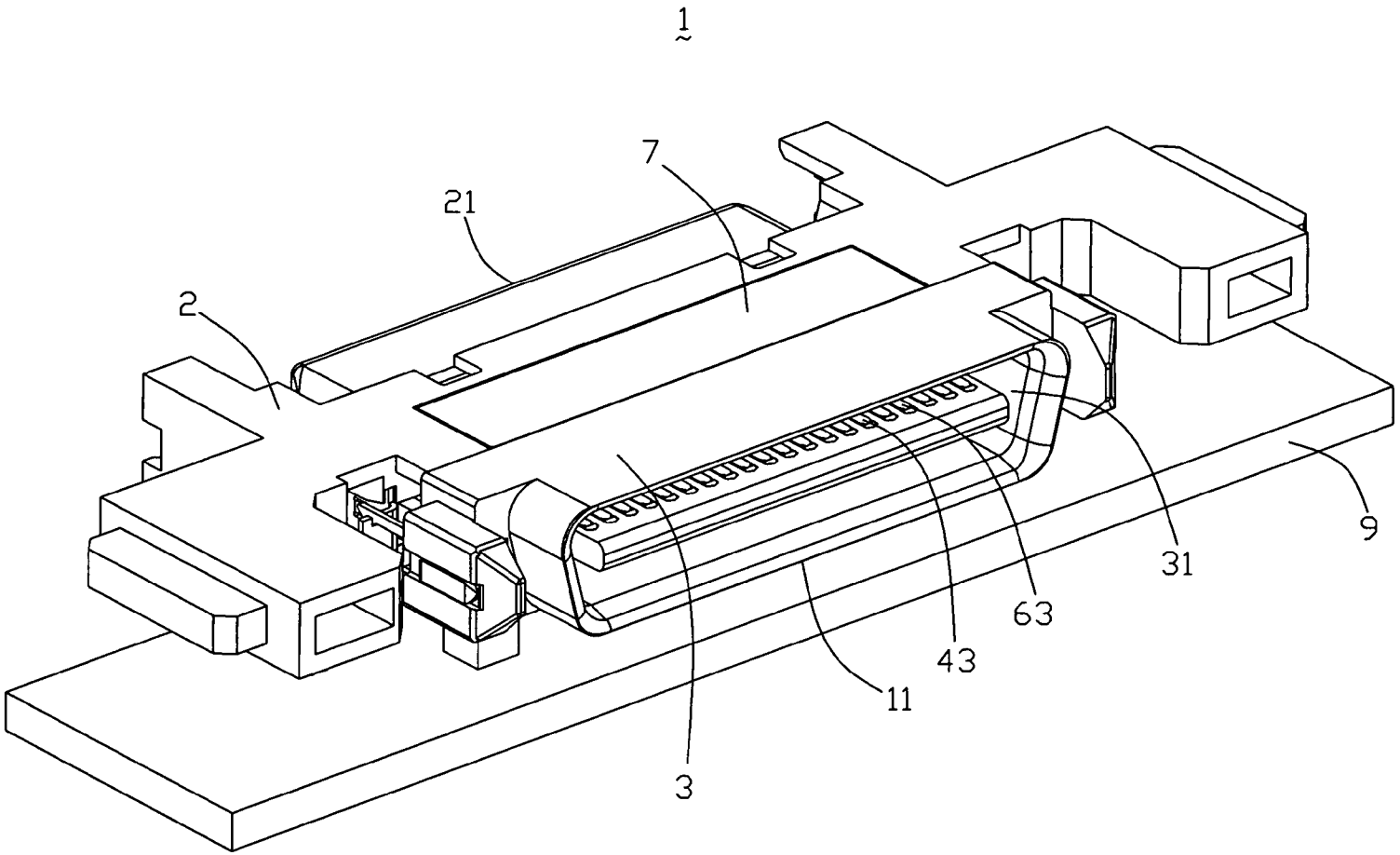
FIG. 1 is an assembled, perspective view of a connector assembly to an embodiment of the present invention.
Figure 2:
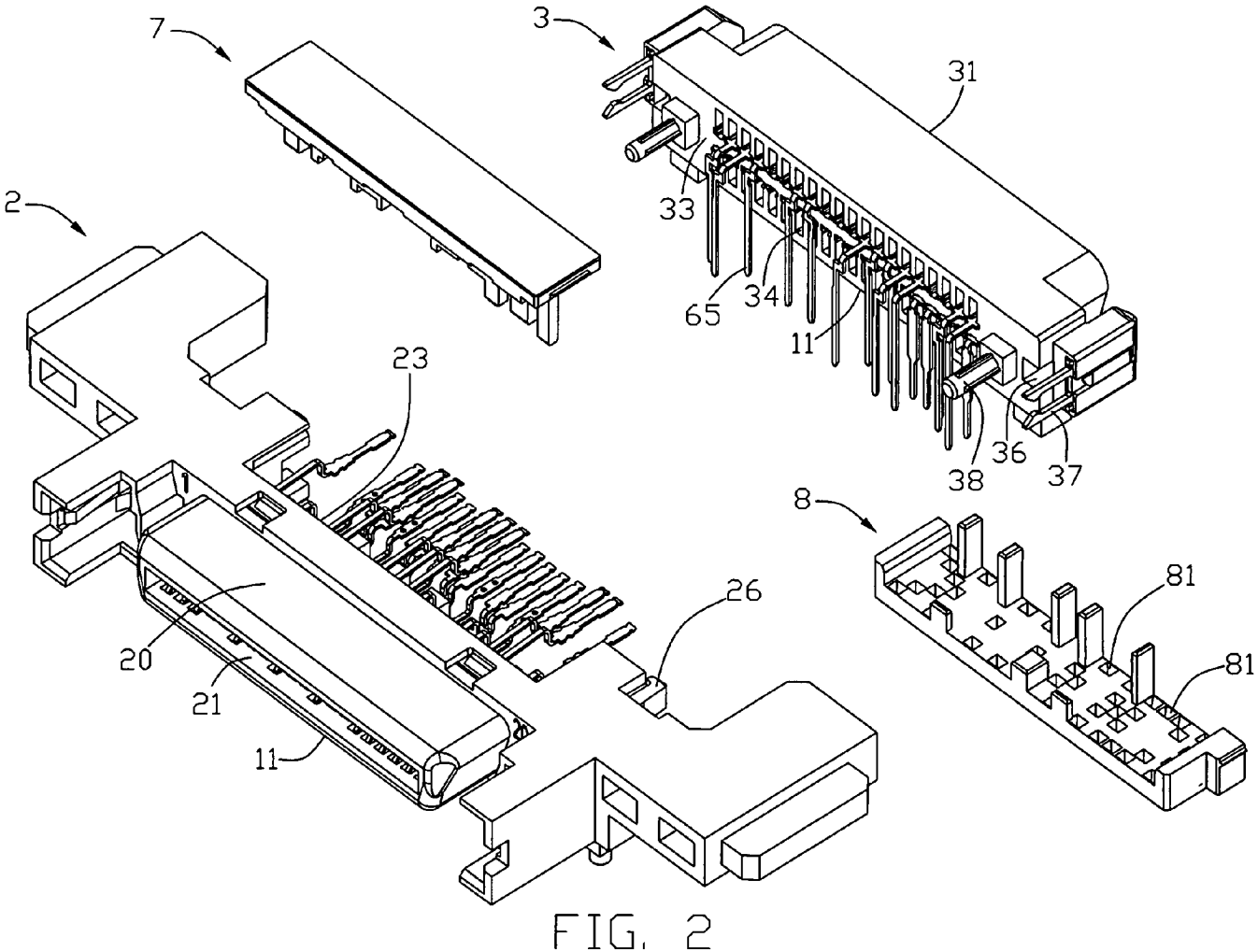
FIG. 2 is an exploded, perspective view of the connector assembly to an embodiment of the present invention.
Figure 3:
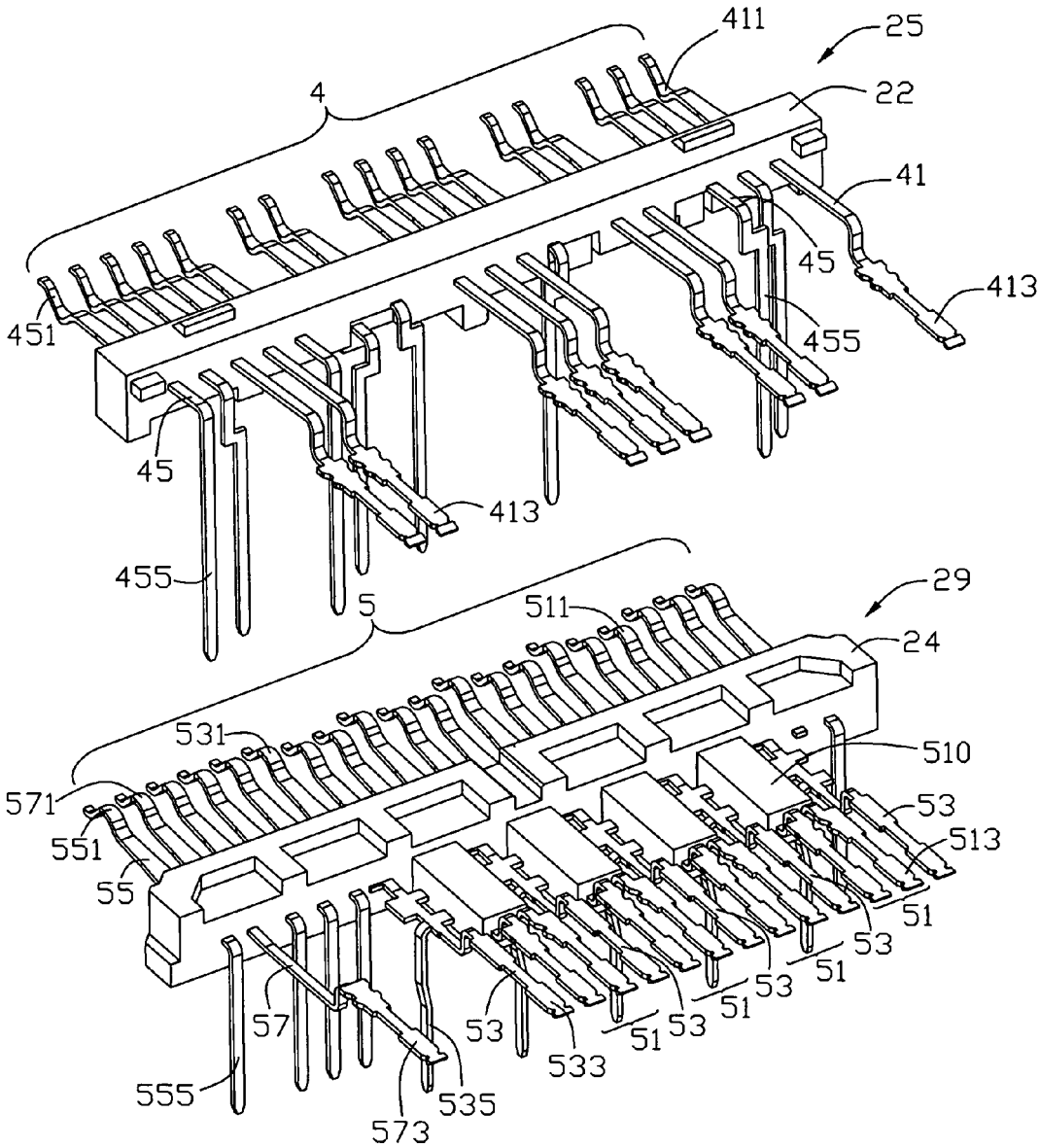
FIG. 3 is an exploded, perspective view of a contact module assembly of the connector assembly to an embodiment of the present invention.

As shown in FIGS. 1 and 2, a connector assembly 1 made in accordance with the present invention comprises a female connector 2 and a male connector 3 assembled together and is intended to be mounted onto a printed circuit board 9. The female connector 2 includes a first mating face 21 that interfaces with a mating face of a corresponding connector mounted on a hard disk drive (not shown). The male connector 3 includes a second mating face 31 opposite to the first mating face 21 and adapted to mate with a connector mounted on a backplane (not shown). Of course, it should be appreciated that interfacing of hard disk and backplane is merely a typical embodiment of the present invention, and it is appreciated that the present invention can be also used with other interface, such as a cable assembly and a hard disk, and other interconnection currently available in the market. The connector assembly further includes a mounting face 11 that is orthogonal to the first and second mating faces 21, 31 to be adapted to face with the printed circuit board 9. Typically, according to an embodiment of the present invention, the printed circuit board 9 supplies two or more than two predetermined voltages to the female connector 2 and/or the male connector 3, respectively, thereby achieving a flexible connection for the connector assembly 1 to different types of hard disk and backplane.

Referring now to FIGS. 3-6, the female connector 2 made in accordance with the present invention includes a first insulative housing 20 that has the first mating face 21 and a first abutment face 23 opposite to the first mating face 21. The female connector 2 further comprises two contact modules 25, 29 that respectively have a first row of contacts insert-molded to a first base 22 and a second row of contacts insert-molded to a second base 24. The first row of contacts 4 is configured by a first type of contact 41 which extends from the female connector 2 to the male connector 3, and a second type of contact 45 which is arranged within the female connector 2 only. Each of the first type of contacts 41 includes a first contact engaging portion 411 which is accessible from the first mating face 21 of the female connector 2, and includes a second contact engaging portion 413 extending away from the first engaging portion 41 and is accessible from the second mating face 31 of the male connector 3 when assembled therein. Each of the second type of contacts 45 includes a first contact engaging portion 451 which is accessible from the first mating face 21 of the female connector 2, and a tail portion 455 that is orthogonal to the first contact engaging portion 451 and extends to the mounting face 11 for electrical connection to the printed circuit board 9.

Each of the second row of contacts 5 includes a plurality of differential pairs of signal contact 51, a plurality pairs of ground contact 53 with the pairs of signal contacts 51 arranged therebetween, and a plurality of signal/power contacts 55, 57. Each of the differential pairs of signal contact 51 includes a median portion which are covered with molded material 510, according to a preferred embodiment, it is a plastic material, a first contact engaging portion 511 extending from the median portion and which is accessible from the first mating face 21, and a second contact engaging portion 513 extending away from the first engaging portion 511 and which is accessible from the second mating face 31.

Figure 4:
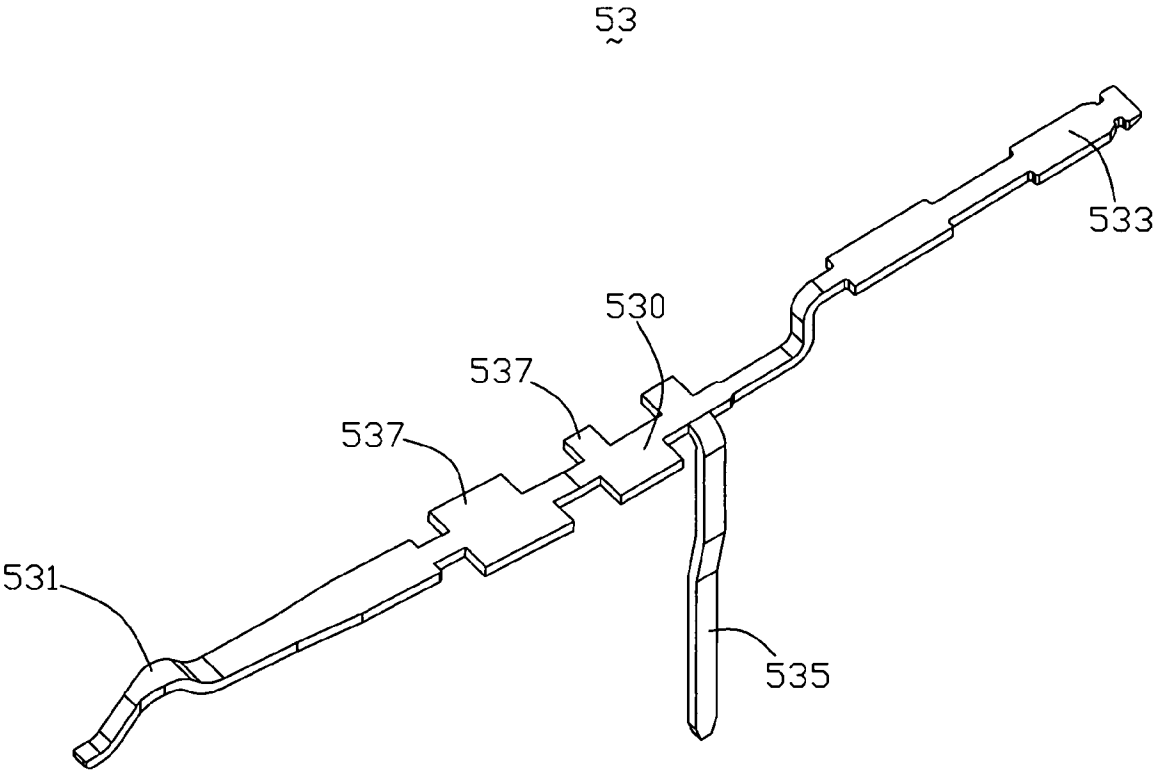
FIG. 4 is an isometric view of a ground contact of the connector assembly to an embodiment of the present invention.

FIG. 4 illustrates an exemplary ground contact 53 which not only extends between the female and male connectors, but also includes a tail portion 535 extending downwardly and adapted to be mounted onto a printed circuit board. The ground contact comprises a median portion 530, a first contact engaging portion 531 extends from the median portion 530 which could be accessible from the first mating face 21, a second contact engaging portion 533 extending from the median portion 530 and opposed to the first engaging portion 531 and which is accessible from the second mating face 31, and the tail portion 535 extending from the median portion 530 that is orthogonal to the first and second contact engaging portion 531, 533 for electrical connection to the printed circuit board 9. The ground contact further includes several separated wing portions 537 extending from the median portion 530 and toward the adjacent differential pair signal contacts 51, creating preferably electrical coupling with respect to those differential pair contacts. The wing portions 537 are arranged such that some of the adjacent wing portions 537 defines an opening.

The signal/power contacts is configured by a first type of contact 57 which extends from the female connector 2 to the male connector 3, and a second type of contact 55 which is arranged within the female connector 2 only. The first type of contact 57 includes a first contact engaging portion 571 which is accessible from the first mating face 21 of the female connector 2, and a second contact engaging portion 573 extending away from the first engaging portion 571 and is accessible from the second mating face 31 of the male connector 3 when assembled therein. The second type of contacts 55 includes a first contact engaging portion 551 which is accessible from the first mating face 21 of the female connector 2, and a tail portion 555 that is orthogonal to the first contact engaging portion 551 and extends to the mounting face 11 for electrical connection to the printed circuit board 9.

Figure 5:
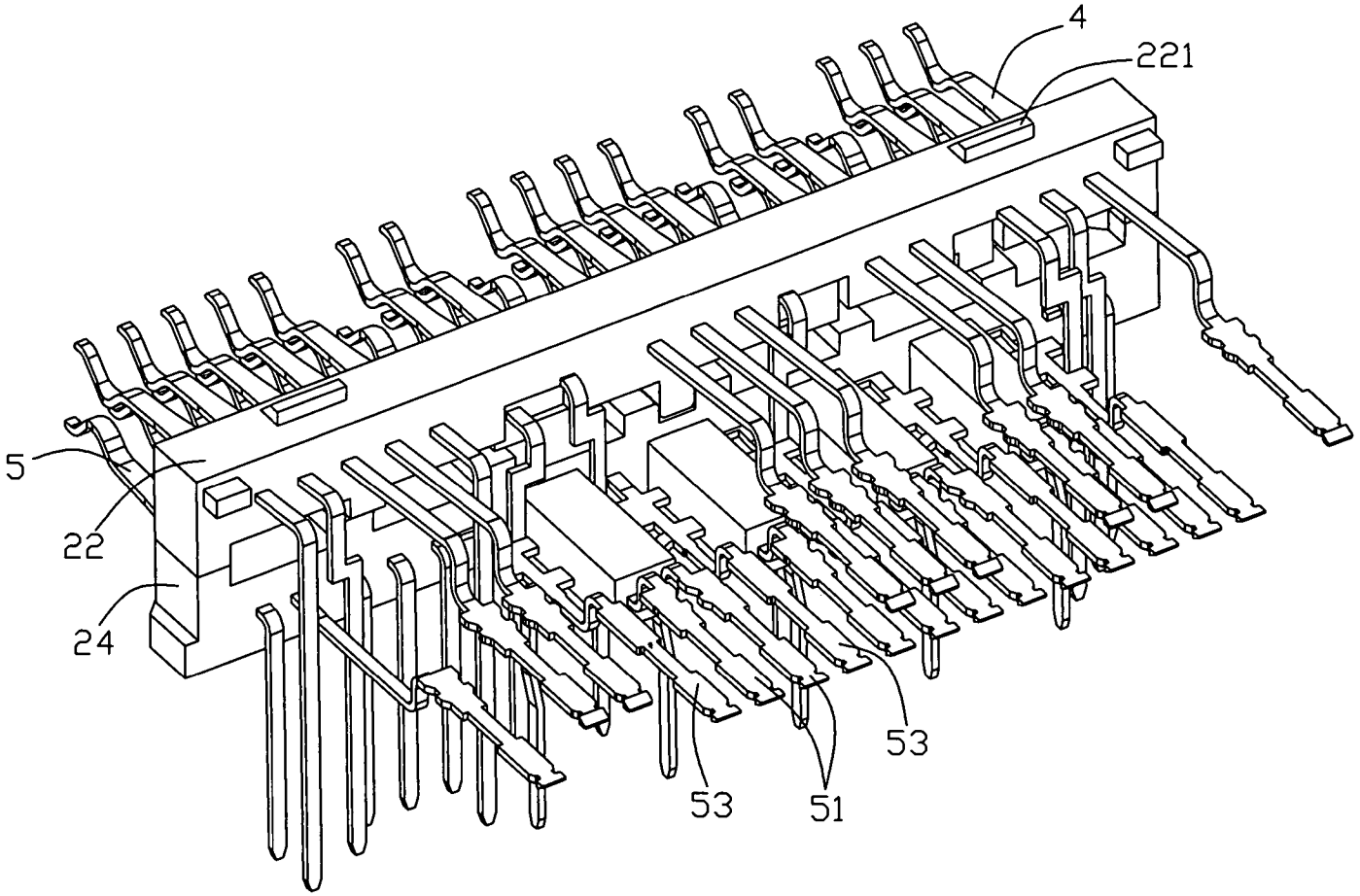
FIG. 5 is an assembled, perspective view of the contact module assembly of the connector assembly to an embodiment of the present invention.
Figure 6:
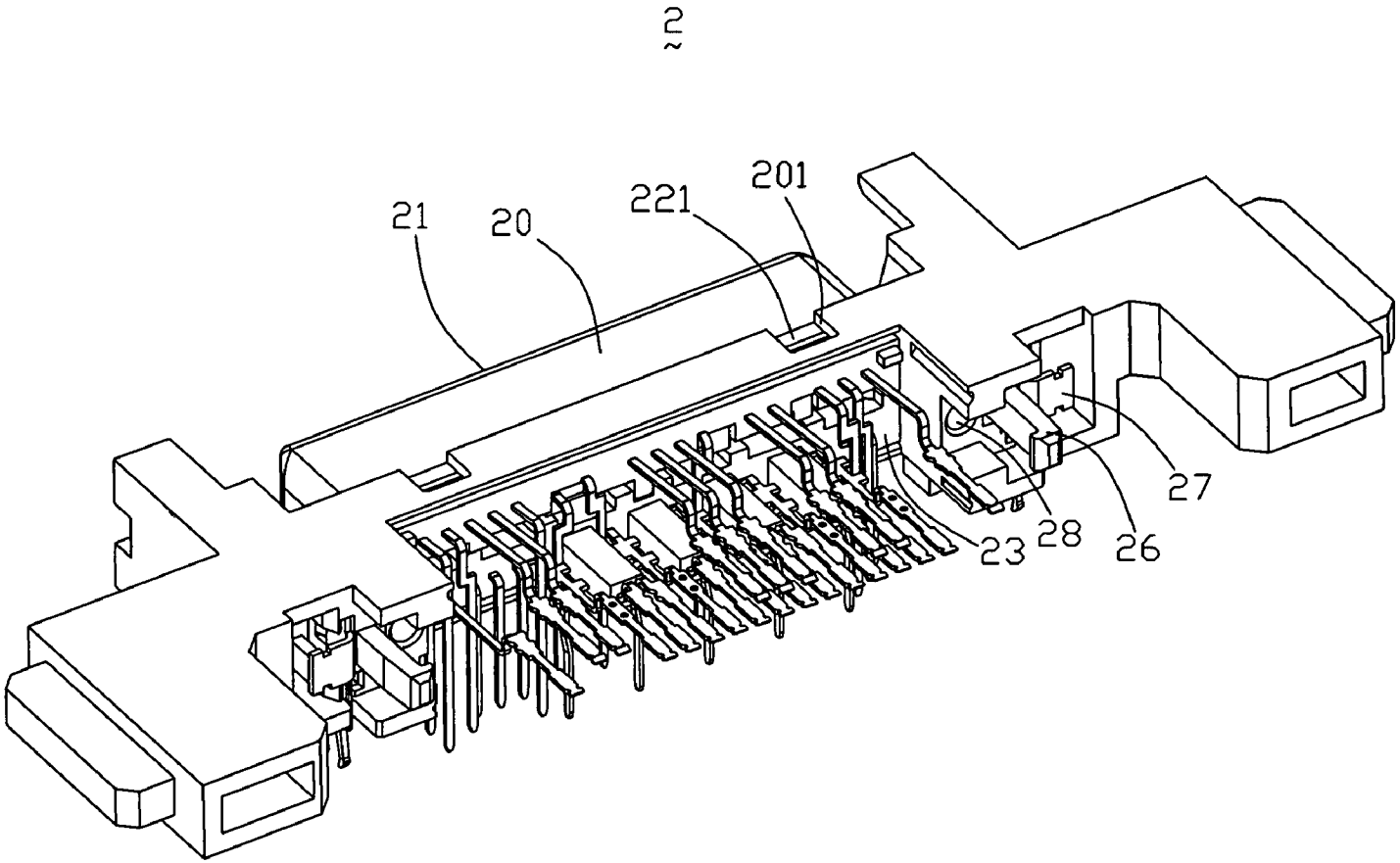
FIG. 6 is a perspective view of a female connector of the connector assembly to an embodiment of the present invention.
Figure 7:
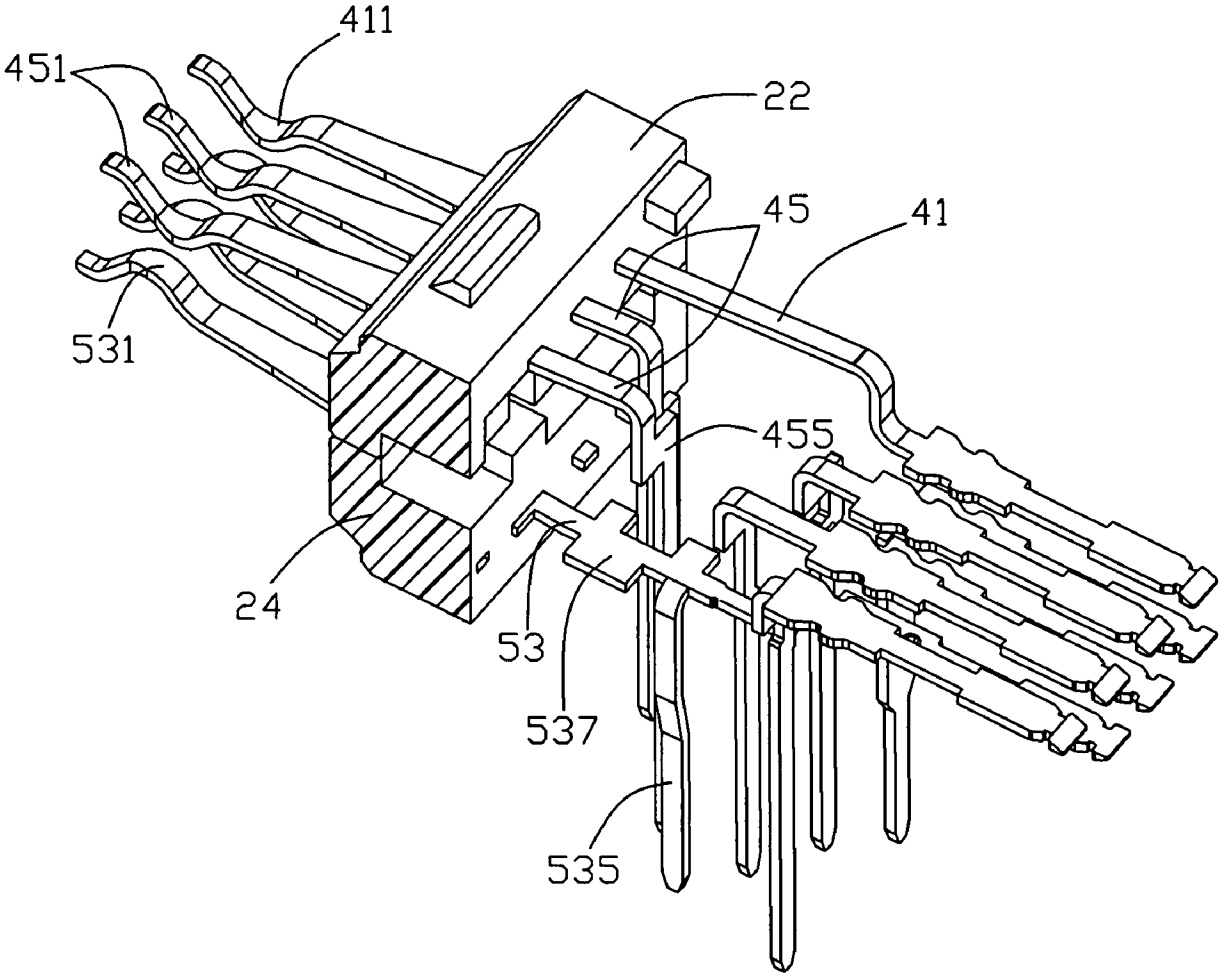
FIG. 7 is a partial of perspective view of the connector assembly to an embodiment of the present invention.

As shown in FIGS. 5-7, the contact modules 25, 29 are assembled together to be a module assembly. It can be noted that part of the tail 455 of the second type of contact 45 is shifting away from the middle line of the first contact engaging portion 451, so as to sidestep the median portion 530 of the ground contact 53 to connect to the print circuit board 9. Pairs of locking blocks 221 are formed on the base 22, 23 so as to be engaged to correspondent pairs of cavities 201 of the first insulative housing 20 for fastening the module assembly to the first insulative housing 20.

Figure 8:
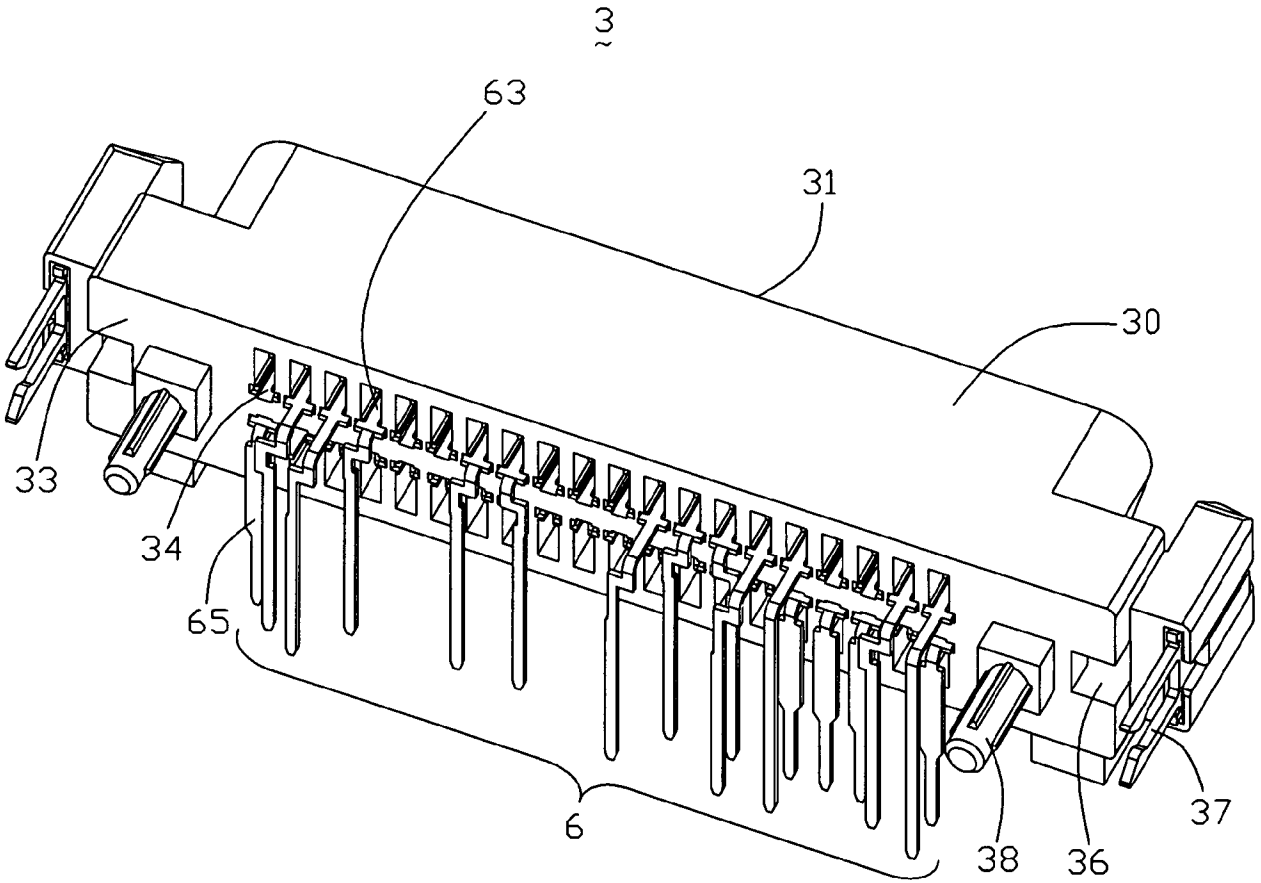
FIG. 8 is a perspective view of a male connector of the connector assembly to an embodiment of the present invention.

With respect to FIG. 8, the male connector 3 includes a second insulative housing 30 that has a second mating face 31 and a second abutment face 33 opposite to the second mating face 31. A plurality of passageways 34 extend from the mating face 31 to the abutment face 33 to receiving the second engaging portion 43, 513, 533, 553 of the two rows of contacts 4, 5 from the female connector and a plurality of contacts 6 that extend from the second mating face 31 toward the mounting face 11. Each of the contacts 6 has a right angle configuration, with a second contact engaging portion 63 which is accessible from the second mating face 31, and a tailing portion 65 extending orthogonal to the first contact engaging portion 63 to be electrical connection to the printed circuit board 9.

Referring to FIGS. 2 and 6-8, the first abutment face 23 of the female connector 2 and the second abutment face 33 of the male connector 3 include interengaging elements extending therefrom for fastening the female connector 2 to the male connector 3. More specifically, the second abutment face 33 of the male connector 3 has a pair of indents 36 extending thereinto for latchably receiving the inwardly oriented latches 26 disposed adjacent to two ends of the first abutment face 23 of the female connector 2. A pair of alignment posts 38 extending outwardly therefrom for being engagably received within alignment slots 28 of the first abutment face 23. A pair of metal latches 37 secured in the side wall of the male connector 3 for locking a pair of metal plates 27 securely to adjacent two ends of the female connector 2. Therefore, the male connector 3 and the female connector 2 could be assembled together. In addition, the connector assembly further includes a middle cover 7 disposed on a top region between the female connector 2 and the male connector 3, and a middle spacer 8 on a bottom region between the female connector 2 and the male connector 3. The middle spacer 8 defines a plurality of through holes 81 for receiving the tailing portions 45, 535, 555, 65 of the contacts 4, 5, 6 to be penetrated therethrough so as to be electrical connection to the printed circuit board 9.

The manufacturing procedures of the present invention starts from assembling the female connector 2. First, provide the first contact module 25 including the first row of contacts 4, provide the second contact module 29 including the second row of contacts 5, and mold the first and second contact modules together to be a module assembly. Then, assemble the module assembly into the first housing 20 and let the first contact engaging portion 41, 511, 531, 551 accessible from the first mating interface 21. As a result, the female connector shown in FIG. 6 is obtained.

Next, provide the male connector 3 with a plurality of contacts 6 that includes a second contact engaging portion 63 secured in the passageways 34 and accessible from the second mating face 31, then assemble the male connector 3 to the female connector 2 by inserting the second contact engaging portion 413, 513, 533, 573 of contacts 4, 5 of the female connector 2 to the passageways 34 and accessible from the second mating face 31of the male connector 3, and the first abutment 23 of the female connector 2 confronts the second abutment 33 of the male connector.

Finally, attach the middle cover 7 on the top region between the female connector 2 and the male connector 3, and assemble the middle spacer 8 with through holes on a bottom region between the female connector 2 and the male connector 3 for receiving the tail portions 45, 535, 555, 65. Therefore, the connector assembly is completely.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A connector assembly comprising:

an insulative housing having a first mating face and a second mating face different from the first mating face, and a mounting face angled to the first and second faces; a plurality of first contact terminals each unitarily having only one first contact engaging portion accessible from the first mating face and configured to mate with a first complementary connector inserted into the first mating face; a plurality of second contact terminals each unitarily having only one second contact engaging portion accessible from the second mating face and configured to mate with a second complementary connector inserted into the mating face; and a plurality of third contact terminals each unitarily having a first engaging portion accessible from the first mating face and configured to mate with said first complementary connector, and a second engaging portion accessible from the second mating face, said second engaging portion configured to mate with said second complementary connector; wherein the mounting face is orthogonal to the first and second faces and said first face is opposite to the second face along a mating direction of said first mating face.

2. The connector assembly as claimed in claim 1, wherein the first contact terminals, the second contact terminals and the third contact terminals are all equipped with corresponding tails which are confined in an insulative spacer.

3. The connector assembly as recited in claim 1, wherein the third contact terminals include at least one pair of differential signal contacts or one signal contact.

4. The connector assembly as recited in claim 3, wherein the third contact terminals further comprise a pair of ground contacts arranged with the pair of differential signal contacts therebetween.

5. The connector assembly as recited in claim 4, wherein the pair of ground contacts each comprises a median portion, a first contact engaging portion extending from the median portion, a second contact engaging portion extending from the median portion opposite to the first engaging portion, and a pair of wings extending laterally from the median portion toward the adjacent signal contact.

6. The connector assembly as recited in claim 1, wherein the third contact terminals include at least one pair of ground contacts.

7. The connector assembly as recited in claim 6, wherein the pair of ground contacts each comprises a median portion, a first contact engaging portion extending from the median portion, a second contact engaging portion extending from the median portion opposite to the first engaging portion, and a tail portion extending from the median portion and away from the first face and the second face toward the mounting face.

8. The connector assembly as recited in claim 7, wherein the first contact terminal further includes a first tail extending toward the mounting face, and the first contact terminal is essentially located at an upper level, and the third contact terminal is essentially at a lower level under a condition that the median portion defines a cutout to allow the first tail to downwardly extend toward the mounting face.

9. An extender comprising:

a first connector having a first mating face, and a second connector opposite to the first connector and with a second mating face;

a pair of signal contacts arranged between the first and second connector, each with a first mating portion accessible in the first connector, and a second mating portion accessible in the second connector;

a pair of ground contacts with the pair of signal contacts arranged therebetween, and at least one of the ground contacts including a first type of ground contact having a median portion, a first mating portion extending from the median portion and accessible in the first connector, and a second mating portion extending from the median portion and accessible in the second connector, and a tail portion extending from the median portion in an extension direction different from that of any one of the first mating portion and the second mating portion and away from the first and second mating portions.

10. The extender as recited in claim 9, further comprising a second type of ground contact includes a first part arranged in the first connector, and a second part discrete to the first part and arranged in the second connector.

11. The extender as recited in claim 9, wherein the first type of ground contact includes wing portions extending from the median portion toward the adjacent signal contacts.

12. The extender as recited in claim 9, further comprising a cover arranged between the first and second connectors.

13. The extender as recited in claim 9, further comprising a spacer with a plurality of through holes for locating the tail portion of the first type of ground contact.

14. An electrical connector assembly comprising:

an insulative housing defining opposite first and second mating faces respectively formed by first and second housing units;

a mounting face defined orthogonal to said first and second mating faces;

a plurality of first contact terminals each unitarily defining a first contact engaging portion at the first mating face for mating with a first complementary connector and a first tail at the mounting face for mounting to a printed circuit board;

a plurality of second contact terminal each unitarily defining a second contact engaging portion at the second mating face for mating with a second complementary connector and a second tail at the mounting face for mounting to the printed circuit board;

a plurality of third contact terminals each unitarily defining a first engaging portion at the first mating face for mating with said first complementary connector and a second engaging portion at the second mating face for mating with the second complementary connector and a third tail at the mounting face for mounting to the printed circuit board; and a plurality of fourth contact terminals each unitarily defining a first engaging section at the first mating face for mating with the first complementary connector and a second engaging section at the second mating face for mating with the second complementary connector while without any tails at the mounting face for mounting to the printed circuit board.

15. The electrical connector assembly as claimed in claim 14, further including an insulative spacer assembled with the housing and defining said mounting face thereof.

16. The electrical connector assembly claimed in claim 15, wherein there are at least five rows of through holes formed in the spacer to respective receive the tails of the corresponding first contact terminals, second contact terminals and the third contact terminals.

17. The electrical connector assembly as claimed in claim 14, wherein each of the third contact terminals extends along a front-to-back direction having two opposite elongated lateral edges thereof, and the tail extends from one of said lateral edges.

18. The electrical connector assembly as claimed in claim 14, wherein the first contact engaging portion is stiff while the second engaging portion is resilient, the first engaging portion is stiff while the second engaging portion is resilient, and the first engaging section is stiff while the second engaging section is resilient.

19. The electrical connector assembly as claimed in claim 14, wherein all said first, second, third and fourth contact terminals are arranged in upper and lower rows, some of said third contact terminals in the lower row each defining a cutout in a lateral side to allow the tail of the corresponding contact in the upper row to extend therethrough toward the mounting face without interference.

* * * * *